US011261853B2

(12) United States Patent
Flo et al.

(10) Patent No.: US 11,261,853 B2
(45) Date of Patent: Mar. 1, 2022

(54) PISTON PUMP

(71) Applicant: Robert Bosch GmbH, Stuttgart (DE)

(72) Inventors: Siamend Flo, Schwieberdingen (DE); Oliver Albrecht, Bietigheim-Bissingen (DE); Frank Nitsche, Remseck am Neckar (DE); Andreas Plisch, Marbach (DE); Dietmar Uhlenbrock, Stuttgart (DE); Olaf Schoenrock, Schwieberdingen (DE); Jurij Giesler, Korntal (DE); Ekrem Cakir, Oberriexingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/622,224

(22) PCT Filed: Jun. 7, 2018

(86) PCT No.: PCT/EP2018/065037
§ 371 (c)(1),
(2) Date: Dec. 12, 2019

(87) PCT Pub. No.: WO2019/015862
PCT Pub. Date: Jan. 24, 2019

(65) Prior Publication Data

US 2020/0191129 A1 Jun. 18, 2020

(30) Foreign Application Priority Data

Jul. 20, 2017 (DE) ..... 10 2017 212 498.9

(51) Int. Cl.
*F04B 1/0408* (2020.01)
*F02M 59/10* (2006.01)
(Continued)

(52) U.S. Cl.
CPC ..... *F04B 1/0408* (2013.01); *F02M 59/102* (2013.01); *F02M 59/442* (2013.01);
(Continued)

(58) Field of Classification Search
CPC .... F04B 53/143; F04B 1/0408; F04B 1/0421; F04B 53/16; F16J 15/56; F16J 9/20;
(Continued)

(56) References Cited

U.S. PATENT DOCUMENTS

2005/0200081 A1 9/2005 Stanton et al.
2008/0240949 A1 10/2008 Tackett et al.
(Continued)

FOREIGN PATENT DOCUMENTS

CN 102086859 A 6/2011
CN 103732916 A 4/2014
(Continued)

OTHER PUBLICATIONS

International Search Report corresponding to PCT Application No. PCT/EP2018/065037, dated Sep. 20, 2018 (German and English language document) (5 pages).

*Primary Examiner* — Philip E Stimpert
(74) *Attorney, Agent, or Firm* — Maginot, Moore & Beck LLP

(57) ABSTRACT

A piston pump, in particular a high-pressure fuel pump for an internal combustion engine, includes a pump housing, a pump piston, and a delivery chamber that is delimited at least by the pump housing and the pump piston. The piston pump further includes a seal configured to seal the delivery chamber and a separate guide element configured to guide the pump piston. The seal and the guide element are arranged between the pump piston and the pump housing. The seal is formed as a plastic ring with a substantially sleeve-shaped base portion.

14 Claims, 9 Drawing Sheets

(51) Int. Cl.

| | |
|---|---|
| *F02M 59/44* | (2006.01) |
| *F04B 1/0421* | (2020.01) |
| *F04B 1/0448* | (2020.01) |
| *F04B 53/14* | (2006.01) |
| *F04B 53/16* | (2006.01) |

(52) U.S. Cl.
CPC ..... *F04B 1/0421* (2013.01); *F04B 1/0448* (2013.01); *F04B 53/143* (2013.01); *F04B 53/16* (2013.01)

(58) Field of Classification Search
CPC ..... F16J 9/064; F16J 9/06; F16J 9/00; F02M 59/442; F02M 59/102
USPC ..... 277/438, 439
See application file for complete search history.

(56) References Cited

U.S. PATENT DOCUMENTS

| | | | | |
|---|---|---|---|---|
| 2013/0043661 | A1* | 2/2013 | Binder | F16J 15/3236 277/554 |
| 2016/0215663 | A1* | 7/2016 | Kuroda | F01M 1/02 |

FOREIGN PATENT DOCUMENTS

| | | | |
|---|---|---|---|
| CN | 203730290 | U | 7/2014 |
| DE | 10 2013 226 062 | A1 | 6/2014 |
| DE | 10 2014 202 809 | A1 | 8/2015 |
| DE | 10 2014 226 304 | A1 | 6/2016 |
| DE | 10 2014 226 316 | A1 | 6/2016 |
| JP | 2001-516846 | A | 10/2001 |
| JP | 2007-46713 | A | 2/2007 |
| JP | 2017511858 | A | 4/2017 |

* cited by examiner

PISTON PUMP

This application is a 35 U.S.C. § 371 National Stage Application of PCT/EP2018/065037, filed on Jun. 7, 2018, which claims the benefit of priority to Serial No. DE 10 2017 212 498.9, filed on Jul. 20, 2017 in Germany, the disclosures of which are incorporated herein by reference in their entirety.

BACKGROUND

The disclosure relates to a piston pump, in particular a high-pressure fuel pump for an internal combustion engine.

Piston pumps are known from the prior art which are used, for example, in the case of internal combustion engines with direct petrol injections. Such piston pumps have a gap seal between pump cylinder and pump piston. Pump cylinders and pump pistons are typically produced from stainless steel. Such a gap seal requires high levels of precision during manufacture and mounting of pump cylinder and pump piston, as a result of which high costs arise. The gap which is always present, the size of which cannot be reduced as desired, for example, as a result of coefficients of thermal expansion of materials used, leads in particular in the case of low rotational speeds to a sub-optimal volumetric efficiency.

SUMMARY

The object of the disclosure is to create a piston pump which has a sufficient volumetric efficiency even in the case of low rotational speeds, has a small size, and can be manufactured at low cost.

This object is achieved by a piston pump with the features of the disclosure. Advantageous further developments of the disclosure are indicated in the subordinate claims. Features which are vital to the disclosure are furthermore found in the following description and in the drawings.

The piston pump according to the disclosure has a pump housing, a pump piston and a conveying chamber also delimited at least by the pump housing and the pump piston. According to the disclosure, it is proposed that a seal for sealing off the conveying chamber and a separate guide element for guiding the pump piston are preferably arranged between the pump piston and the pump housing, wherein the seal is formed as a plastic ring which is at least substantially stationary relative to the pump housing with a substantially sleeve-shaped base portion which has, for example, a cylindrical outer surface, and is axially adjacent to the guide element (in the axial direction of the pump piston), in particular indirectly or directly.

Such a piston pump can be produced comparatively easily, as a result of which the component costs are reduced. This is related to the fact that the gap sealing and its pump cylinder which is complex to manufacture is replaced by a seal assembly with a seal and at least one guide. As a result of the configuration of the seal as a plastic ring, advantageous sealing off of the conveying chamber is achieved so that the volumetric efficiency is improved in particular at low rotational speeds. A comparatively small overall size of the piston pump can be achieved as a result of the new seal assembly. The guiding and sealing function are thus realized by separate components, namely by the guide element and the seal plastic ring).

The pump piston can be received in recess in the housing and run to and fro therein. The inner wall of the recess (circumferential wall) can form at least a portion of a running surface for the pump piston. The recess can be formed as a bore, in particular as a stepped bore.

In concrete terms, the (first) guide element can be formed to be annular (guide ring). The guide element can be arranged on that side of the seal which faces the conveying chamber. The guide element can optionally have a radial gap (guide gap) toward the pump piston which is so small that the guide element serves as cavitation protection for the seal. The guide gap is small enough that no vapor bubbles can reach the seal. The risk of damage to the seal is thus reduced.

The seal can be manufactured from a PEEK (polyether ether ketone), PEAK, polyamide-imide (PAI; e.g. PAI which can be obtained under the name Torlon) or comparable materials. The materials can additionally be reinforced and/or optimized by fillers. The seal is in particular a high-pressure seal which seals off a high-pressure region (conveying chamber) from a low-pressure region (region at the side of the seal which faces away from the conveying chamber).

The seal has a radially outer ring edge (outer lateral surface), a radially inner ring edge, a first face side and a second face side. The seal can also have a greater length in the axial direction of the pump piston than in each case the guide element and/or the fastening ring. Installation space can thus be obtained for different configurations of the seal, wherein the axial length can be kept small.

The seal can be based on a groove ring seal, but be optimized in terms of design and have different cross-sections. The wall thickness of the seal (wall thickness in the radial direction) is designed depending on the system pressure. The wall thickness can be 0.1 mm-3.0 mm (millimeters). The seal can have, in relation to the pump piston, an oversize (compression), an undersize (play) or a transition fit. A configuration of the seal with radial play toward the pump piston is advantageous for low friction and low wear, in particular with play of 0.001 mm-0.1 mm.

In the simplest case, the seal, as already mentioned above, can be formed to be sleeve-shaped. The seal then has an I-shaped cross-section, in particular with a profile which is rectangular in cross-section. The I-shaped cross-section can form a base portion of the seal. Alternatively to an I-shaped cross-section, the seal can have an L-shaped or a U-shaped cross-section.

In the context of one preferred configuration, a further guide element can be provided which is arranged in a seal carrier of the piston pump. A comparatively large bearing distance to the (first) guide element is realized with this. The guidance of the pump piston is thus optimized. The further guide element can be formed to be annular (guide ring).

A fastening ring for the seal can advantageously be arranged between the pump housing and the pump piston. The fastening ring is arranged in particular on the side of the seal facing away from the conveying chamber. The fastening ring forms a seat for the seal. The seal is thus secured against axial displacement, in particular away from the conveying chamber. The fastening ring can be fastened to the recess which receives the pump piston, e.g. screwed in, glued or pressed in. In particular the fastening ring and the seal can be formed such that a static sealing point is formed when the seal bears against the fastening ring. In order to enable a positioning in the radial direction between piston and seal, the seal can have axial play, for example, of 0.01 mm-1 mm ("floating seal"). The seal, the guide element, the further guide element and the fastening ring form a seal assembly.

A spring element which pushes the seal against the fastening ring can preferably be arranged between the pump piston and the pump housing. The spring element can (in the axial direction of the pump piston) be arranged between the guide element and the seal. The spring element can bear at one end axially, for example, against the guide element and at the other end push the seal against the fastening ring. The spring element can be formed as a pressure spring, in particular as a spring disk or helical spring. The spring element can at least partially surround the pump piston. As a result of the spring element, an axial force acts on the seal, wherein this force pushes onto that axial end surface of the seal which faces the conveying chamber. The axial force brings about that the seal rests on the fastening ring so that an initial imperviousness at the static sealing point is ensured. As a result of this in combination with the throttling at the dynamic sealing point between seal and piston in the conveying phase, an initial pressure is built up in the conveying chamber which facilitates pressure activation of the seal.

In the context of one preferred configuration, the seal can have at one (first) axial end a radially outwardly projecting, in particular circumferential web. In other words, the web projects radially on the outer lateral surface of the seal (base portion). The seal thus has an L-shaped cross-section. The rigidity of the seal is increased as a result of the web. The seal can furthermore be centered in a radial direction in the pump housing. As a result of this, the seal can be installed in a fixed position in the pump housing. The axial end with web can face the conveying chamber or face away from the conveying chamber. The web can be formed as an annular shoulder. The length of the web is to be adapted to the application and the prevailing system pressure. The web can have, for example, a length of 0.2 mm-2 mm.

The seal can advantageously have, at a second axial end, a further radially outwardly projecting web (further web projects from the base portion). The seal thus has a C- or U-shaped cross-section. The rigidity of the seal is once again increased by the further web. The centering of the seal in the radial direction in the pump housing is once more improved. The arrangement of the seal in a fixed position in the pump housing is facilitated. The further web can be formed as an annular shoulder. The further web can have, for example, length of 0.2 mm-2 mm.

According to one preferred configuration, the web and/or the further web can have radial play at their radially outer edge to the circumferential wall of the recess which receives the pump piston, for example, of 0.001-1 mm. In other words, the webs have an outer diameter which is slightly smaller than the inner diameter of the recess (bore) which receives the pump piston at the point at which the seal sits. This play brings about that the radial position of the seal can be adjusted precisely to the position of the pump piston. A uniform and symmetrical gap to the pump piston can thus be produced.

In each intake phase of the pump piston (pump piston moves away from the conveying chamber), there is the possibility of a reorientation of the seal. In the conveying phase (pump piston moves to the conveying space, compresses and conveys fuel), a conveying pressure builds up on that side of the seal which faces the conveying chamber. This pressure acts on the (first) face side of the seal and brings about that the seal is subjected to a force in the axial direction which pushes the seal onto the fastening ring.

During the conveying phase, the seal cannot move in the radial direction or only to an insignificant extent as a result of the axial force acting on it. A static sealing point can arise between the contact surfaces of the seal (second end surface) and of the fastening ring. As a result of this, fuel is prevented from escaping from the conveying chamber and the volumetric efficiency is thus not reduced. The contact surfaces of seal and fastening ring can be oriented transversely, in particular orthogonally (angle of 90±2°, to the axial direction of the pump piston.

The seal can expediently have at the (first) axial end, on which the web is arranged, at the face side a circumferential collar. As a result of the collar, it is ensured that the axial force which acts from the conveying chamber on the seal runs with an optimum force profile through the seal and is introduced precisely into the static sealing point (contact surface between the seal and the fastening ring). An increased surface pressure and an even better static sealing action are thus achieved. The collar projects in the axial direction from the seal. The collar is arranged at the face side in particular on the radially internal ring edge of the seal.

The (first) guide element and the fastening ring can advantageously be formed in a combined manner—i.e. in particular in one piece—to form one component. The combined component then takes on the function of guiding and fastening. The number of elements to be manufactured and mounted can be reduced as a result of this. This facilitates a low-cost embodiment of the piston pump. The component and the seal can axially overlap one another. A portion of the component can thus be arranged radially between the pump piston and the pump housing.

In the context of a preferred configuration, an O-ring can be arranged between the radially outer lateral surface of the seal and the pump housing (circumferential wall of the recess for the pump piston). The O-ring has a radially sealing action. As a result of the O-ring, the static sealing point is supplemented and the sealing action is improved.

A supporting ring for the O-ring can furthermore be arranged between the radially outer lateral surface of the seal and the pump housing (circumferential wall of the recess for the pump piston). As a result of this, the O-ring is protected since damage, for example, an extrusion of the O-ring, can be prevented. The supporting ring is arranged in particular on that side of the O-ring which faces away from the conveying chamber and can have a triangular profile in cross-section. The hypotenuse of the triangular profile can face the O-ring.

The seal is in particular a pressure-activated seal. This means that a small gap between the seal and the pump piston is sufficient to build up an initial pressure in the conveying chamber and thus also at the radially outer ring edge (rear side of the seal). As a result of the rear-side pressure on the seal, the seal deforms and as a result reduces the gap to the pump piston at the internal ring edge. As a result of the sealing gap which has become smaller, a greater pressure can be built up in the conveying chamber and thus also on the rear side of the seal so that the seal is deformed to a greater extent by the higher pressure and further reduces the gap to the pump piston. This is a self-reinforcing effect which continues until the system pressure is reached.

The deformation can take place, for example, in the presence of two webs between the two webs. As a result, the sealing effect occurs at a defined point. The seal geometry can be configured so that, when the system pressure is reached, either a very small gap is set, for example, of 0.001 mm-0.01 mm, or the seal bears against the pump piston and the sealing surfaces (of the seal and of the pump piston) touch one another. Whether a gap is still present in the case of system pressure or whether the seal has direct contact with the piston depends on the concrete requirements (volumetric efficiency, wear over life span, etc.). As a result of the pressure activation, very high system pressures can be reached since, the higher the system pressure, the greater the seal deforms and thus the sealing gap becomes ever smaller.

In principle, the seal has a low degree of wear since a tribological contact only arises in the conveying phase (during the pressure activation of the seal). This corresponds precisely to half the running time of the piston pump. In the suction phase (during which no pressure activation takes place), the seal is rinsed by fuel. New fuel is thus always introduced into the sealing gap, which fuel acts as lubricant. As a result of the pressure activation of the seal, it is possible to compensate for wear. In the case of wear of the sealing surface of the seal, the seal deforms as a result of the pressure activation regularly to the gap configured in the fundamental configuration or bears against the pump piston.

BRIEF DESCRIPTION OF THE DRAWINGS

The disclosure is explained in greater detail below on the basis of the figures, wherein identical or functionally identical elements are, where applicable, only provided with reference numbers once. In the figures.

DETAILED DESCRIPTION

Figure 1:
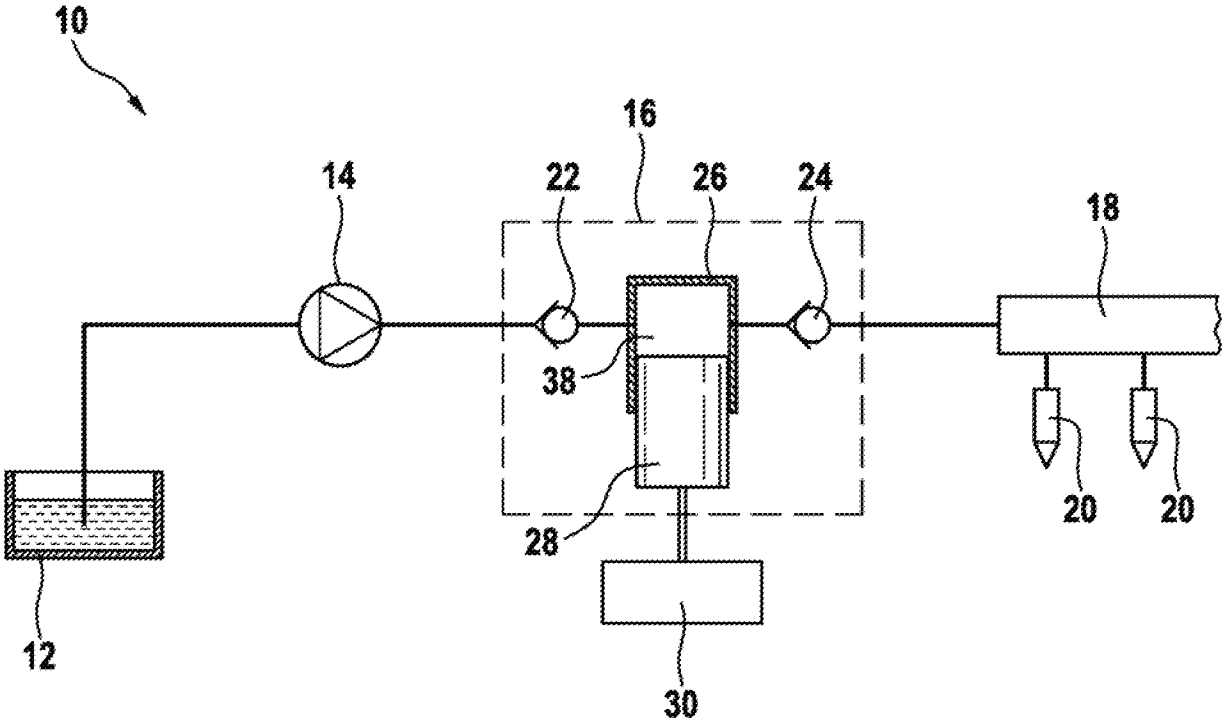
FIG. 1 shows a schematic representation of a fuel system with a high-pressure fuel pump in the form of a piston pump.

A fuel system of an internal combustion engine bears in general in FIG. 1 reference number 10. It comprises a fuel container 12 from which an electric pre-feed pump 14 conveys the fuel to a high-pressure fuel pump formed as a piston pump 16. This conveys the fuel further to a high-pressure fuel rail 18 to which several fuel injectors 20 are connected which inject the fuel into combustion chambers, not represented, of the internal combustion engine.

Piston pump 16 comprises an inlet valve 22, an outlet valve 24 and a pump housing 26. A pump piston 28 is received therein so as to be able to move to and fro. Pump piston 28 is brought into movement by a drive 30, wherein drive 30 is only represented schematically in FIG. 1. Drive 30 can be, for example, a camshaft or an eccentric shaft. Inlet valve 22 is formed as a quantity control valve by which the quantity of fuel conveyed by piston pump 16 can be adjusted.

Figure 2:
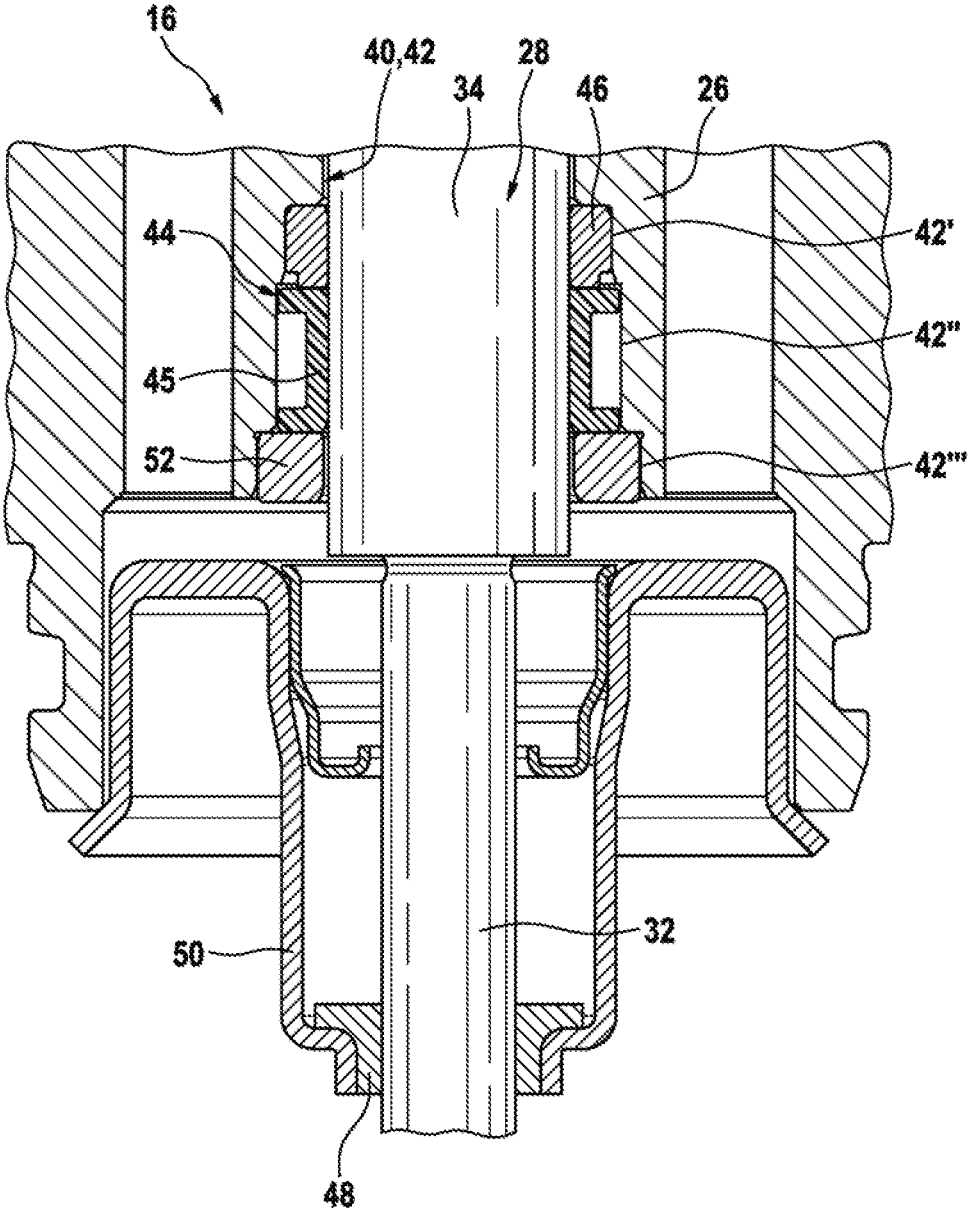
FIG. 2 shows a partial longitudinal section through the piston pump from FIG. 1.

The structure of piston pump 16 is further apparent from FIG. 2, wherein only the key components are mentioned below. Pump piston 28 is formed as a stepped piston with a lower tappet portion 32 in FIG. 2, a guide portion 34 which adjoins it and an upper end portion, not represented in greater detail. Guide portion 34 has a larger diameter than tappet portion 32 and the end portion.

The end portion and guide portion 34 of pump piston 28 delimit together with pump housing 26 a conveying chamber 38, not represented in greater detail. Pump housing 26 can be formed as an overall rotationally symmetrical part. Pump piston 28 is received in pump housing 26 in a recess 40 present there which is formed as a stepped bore 42. Bore 42 has several steps (three steps 42', 42", 42'"; see FIGS. 2 and 3).

A seal 44 is arranged between guide portion 34 of pump piston 28 and an inner circumferential wall of bore 42 (step 42"). It seals directly between pump piston 28 and pump housing 26 and thus seals off the conveying chamber (high-pressure region) located above seal 44 from the region. (low-pressure region) arranged below seal 44 in FIG. 2, in which latter region, among other things, tappet portion 32 of pump piston 28 is located. Seal 44 is formed as a plastic ring. Seal 44 has a substantially sleeve-shaped base portion 45 which has a cylindrical outer surface.

A guide element 46 separate from seal 44 is arranged between guide portion 34 of pump piston 28 and the inner circumferential wall of bore 42 (step 42'). Guide element can be axially adjacent to seal 44 and is arranged above seal 44 in FIG. 2 (facing the conveying chamber) Guide element 46 is formed to be annular (guide ring) and can be fastened to step 42'. Piston pump 16 has a further guide element 48 which is arranged in a seal carrier 50 of piston pump 16 (see FIG. 2). Guide element 46 and further guide element 48 serve to guide pump piston 28. Further guide element 48 is formed to be annular (guide ring) and can be fastened to seal carrier 50.

Piston pump 16 has, between guide portion 34 of pump piston 28 and the inner circumferential wall of bore 42 (step 42'"), a fastening ring 52 for seal 44. Seal 44 lies on fastening ring 52. A static sealing point 53 is formed by the lying contact surfaces of seal 44 and fastening ring 52 (see FIG. 3). Seal 44, guide element 46, further guide element 48 and fastening ring 52 form a seal assembly.

Seal 44 has at its first axial end 54 radially outwardly projecting web 56 (see FIG. 4) which projects from base portion 45. Web 56 is formed as an annular shoulder which radially protrudes over outer lateral surface 58 of seal 44. Web 56 runs fully around seal 44 (lateral surface 58).

Seal 44 has at its second axial end 60 a further radially outwardly projecting web 62 which projects from base portion 45. Further web 62 is also formed as an annular shoulder which radially protrudes over outer lateral surface 58 of seal 44. Further web 62 runs fully around seal 44 (lateral surface 58). Seal 44 has a U-shaped cross-section.

Figure 3:
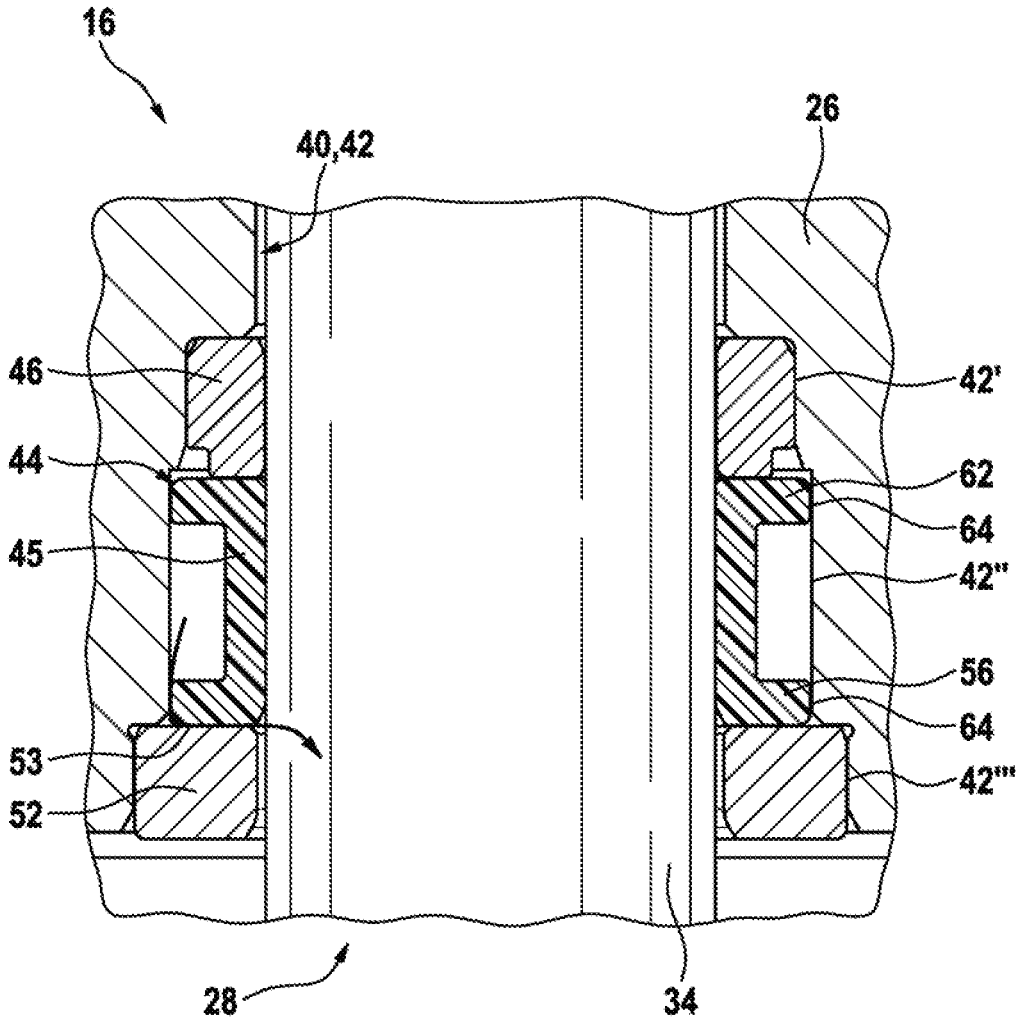
FIG. 3 shows an enlarged view of a pump piston, a seal, a guide element and a fastening ring of the piston pump from FIG. 1.

Web 56 and further web 62 have radial play 64 at their radially outer edge to the circumferential wall of recess 40 which receives pump piston 28 (step 42") (see FIG. 3). As a result of this, seal 44 can be oriented in the radial direction to pump piston 28. Pressure 65 prevailing in the conveying chamber also travels via this gap (play 64) to outer lateral surface 58 so that seal wall 66 undergoes a deformation 69 radially inward (see FIG. 4) as a result of the force acting there (arrow 68). A dynamic sealing point is thus formed between pump piston 28, in particular between guide portion 34, and seal 44 (radially internal ring edge 70).

Figure 4:
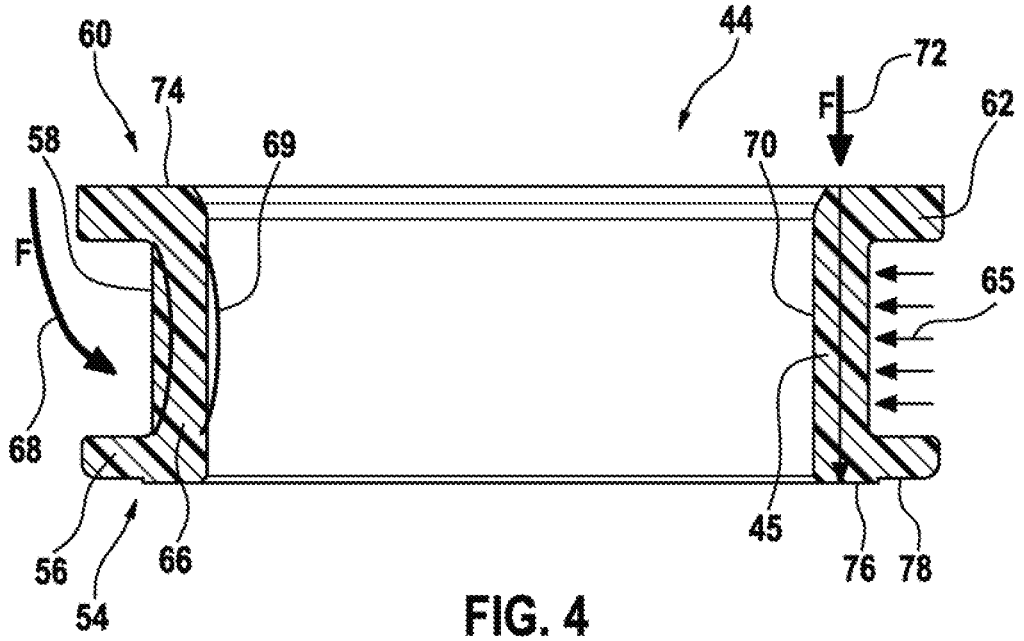
FIG. 4 shows the seal from FIG. 3 in an enlarged sectional view.

The pressure prevailing in the conveying chamber also ensures that a force F (arrow 72) acts on first face side of seal 44 (see FIG. 4 on the right). Seal 44 optionally has a circumferential collar 76 at the face side at first axial end 54, on which web 56 is arranged. It is thus ensured that force F (axial force; arrow 72) optimally runs through seal 44 and is introduced exactly into static sealing point 53. Circumferential collar 76 is formed on radially internal ring edge 70 of seal 44 on second face side 78.

Figure 5:
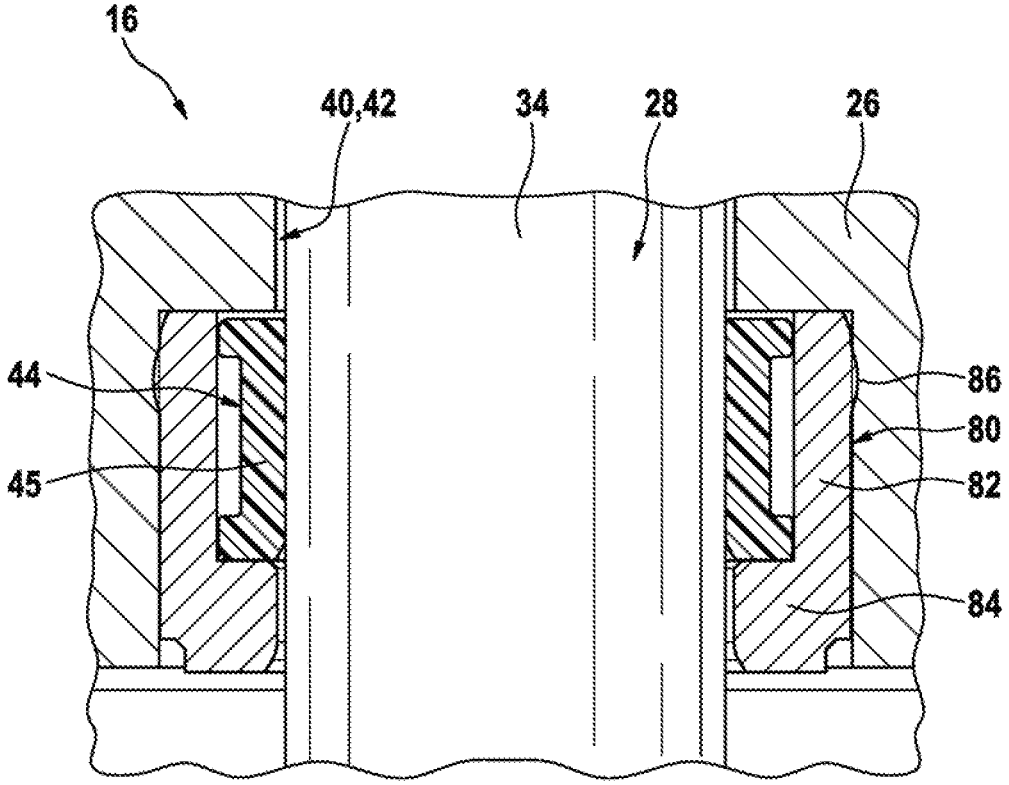
FIG. 5 shows a partial longitudinal section through an alternative configuration of the piston pump from FIG. 1.

According to one alternative configuration, first guide element 46 and fastening ring 52 can be formed in a combined manner to form one component 80 (see FIG. 5). Component 80 takes on the function of guiding and fastening. Component 80 and seal 44 axially overlap one another (axial direction of pump piston 28). An overlapping portion 82 of combined component 80 is thus arranged radially between pump piston 28 (guide portion 34) and pump housing 26 (circumferential wall of bore 42). Guidance can be carried out at a lower portion 84 in FIG. 5. Fastening of component 80 in bore 42 can be carried out in lower portion 84 or in overlapping portion 82, for example, by means of a projection 86 which projects radially outward.

Figure 6:
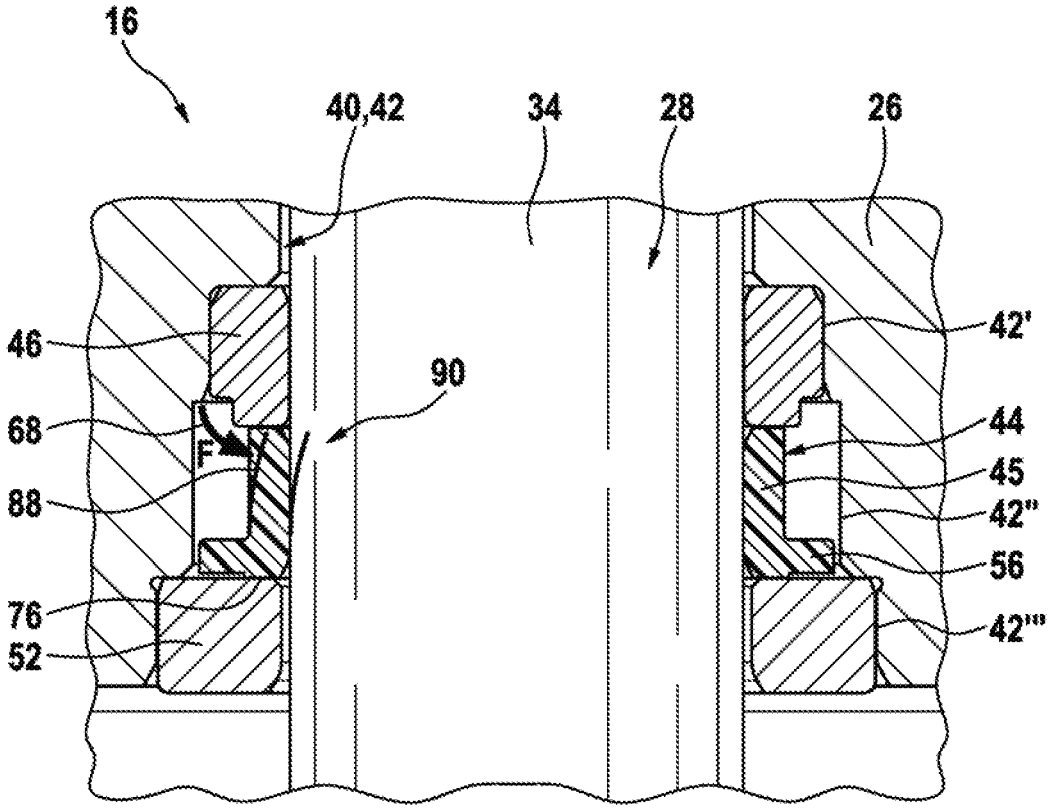
FIG. 6 shows a partial longitudinal section through an alternative configuration of the piston pump from FIG. 1 with seal in a $1^{st}$ orientation.

FIG. 6 shows an alternative configuration of piston pump 16 from FIG. 3, wherein seal 44 only has first web proceeding from base portion 45 and circumferential collar 76. Further web 62 is omitted. Seal 44 thus has an L-shaped cross-section. Web 56 faces fastening ring 52. This brings about a deformation 88 of seal 44 in lower region 90 in FIG. 6 in the case of pressure acting on seal 44 (conveying phase) as a result of force F (arrow 68).

Figure 7:
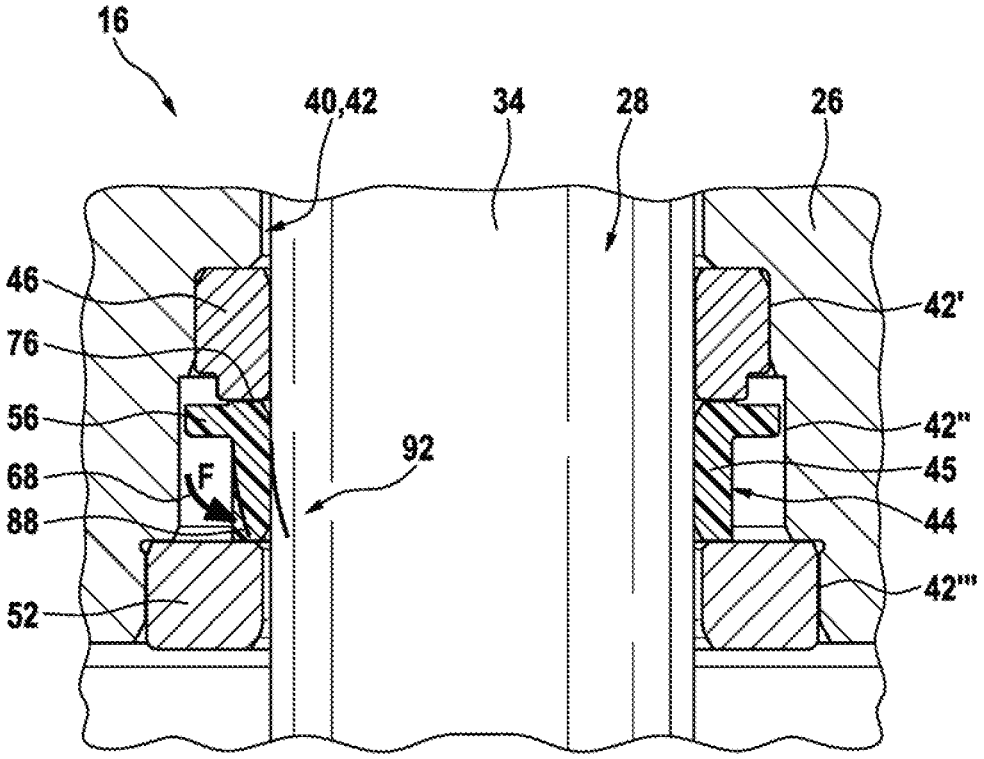
FIG. 7 shows the piston pump from FIG. 6 with seal in a $2^{nd}$ orientation.

FIG. 7 shows further alternative configuration of piston pump 16 from FIG. 3 which corresponds to the configuration of piston pump 16 from FIG. 6, wherein seal 44 is oriented such that web 56 faces (first) guide element 46. This brings about a deformation 88 of seal 44 in lower region 92 in FIG. 7 (facing fastening ring 52) in the case of pressure acting on seal 44 (conveying phase) as a result of force F (arrow 68).

Figure 8:
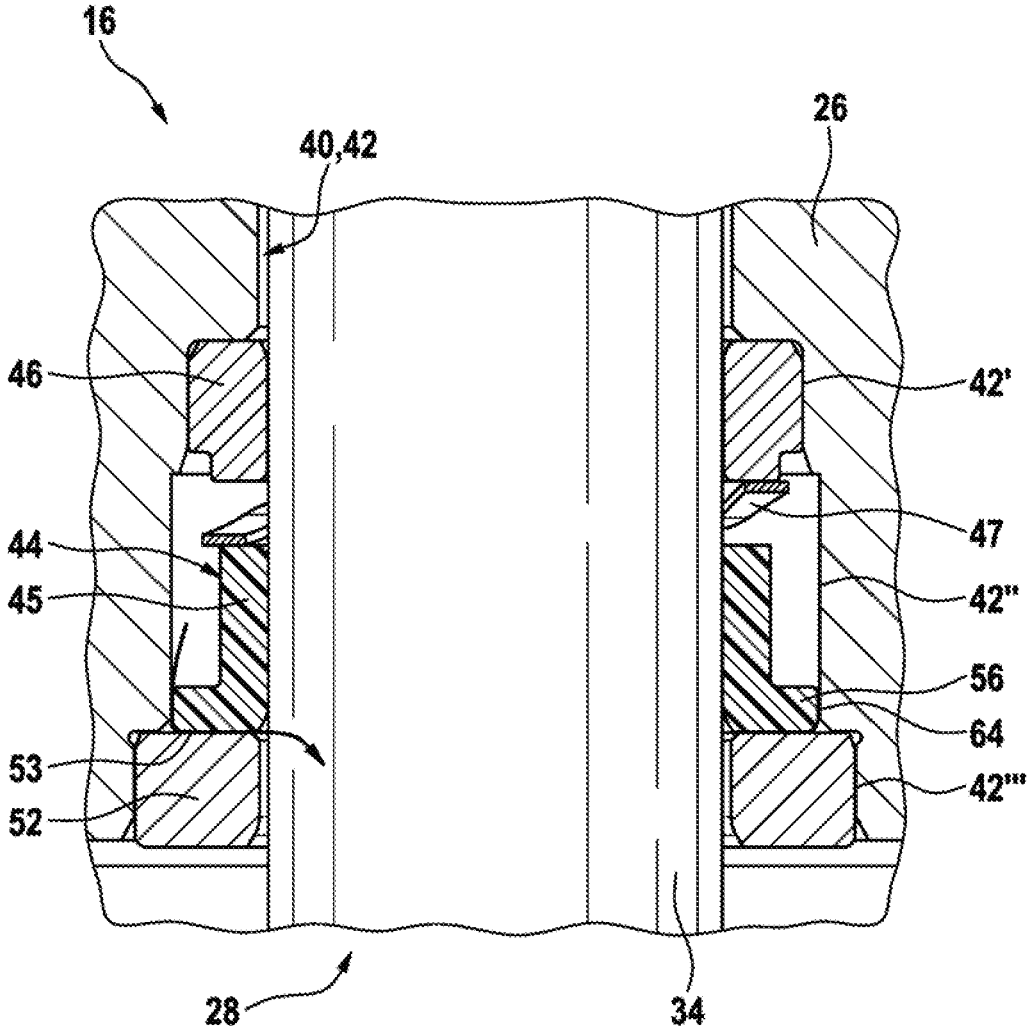
FIG. 8 shows the piston pump from FIG. 6 with a spring element.

FIG. 8 shows a further alternative configuration of piston pump 16 from FIG. 3 which corresponds largely to the configuration of piston pump 16 from FIG. 6 and additionally has a spring element 47. A spring element 47 which pushes seal 44 against fastening ring 52 can thus be arranged between pump piston 28 and pump housing 26. Spring element 47 can, in the axial direction of pump piston 28, be arranged between guide element 46 and seal 44. Spring element 47 can be formed as a pressure spring in the form of spring disk or helical spring. Spring element 47 bears at one end axially, in particular against guide element 46, and at the other end pushes seal 44 against fastening ring 52.

Figure 9:
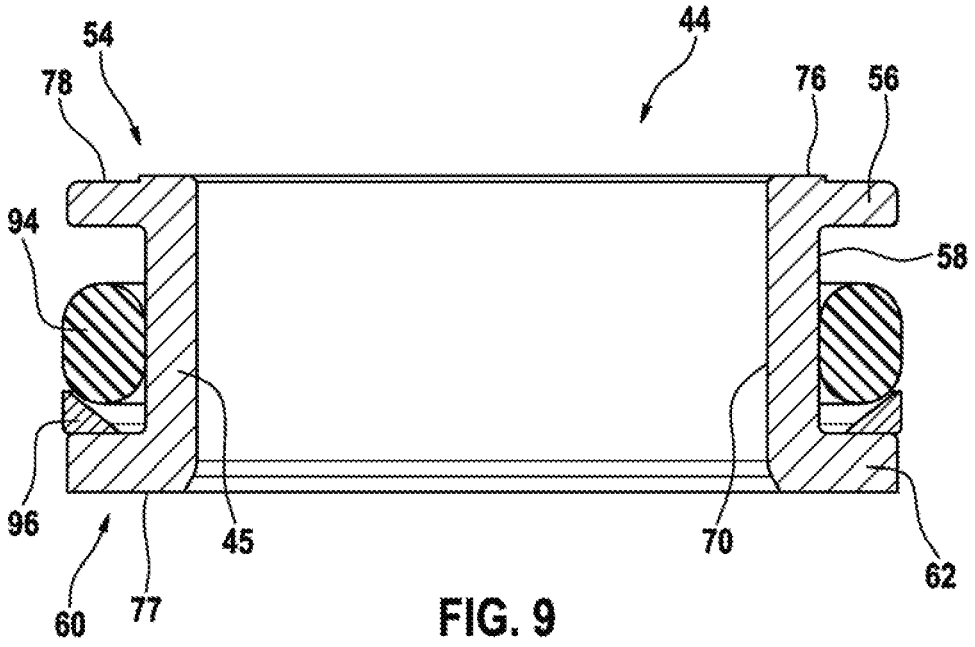
FIG. 9 shows the seal from FIG. 3 in an enlarged sectional view with O-ring and supporting ring.
Figure 10:
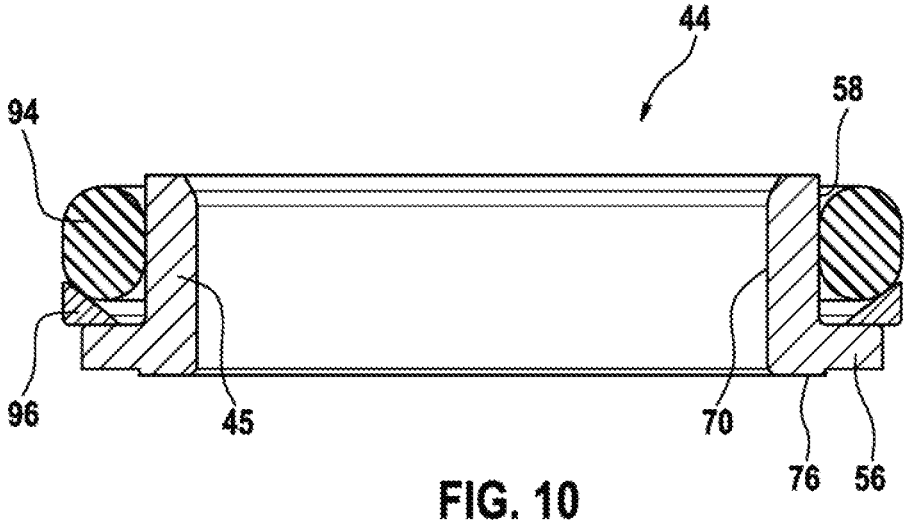
FIG. 10 shows the seal from FIG. 6 in an enlarged sectional view with O-ring and supporting ring.

An O-ring 94 can be arranged between radially outer lateral surface 58 of seal 44 and pump housing 26 (see FIGS. 9 and 10). This serves to reinforce static sealing point 53 and improves the sealing action. A supporting ring 96 for O-ring 94 can furthermore be arranged between radially outer lateral surface 58 of seal 44 and pump housing 26. Supporting ring 96 serves to protect O-ring 94, for example, to avoid an extrusion of O-ring 94. FIG. 9 illustrates the configuration with O-ring 94 and supporting ring 96 at seal 44 with a U-shaped profile in accordance with FIGS. 3 and 4. FIG. 10 illustrates this configuration in the case of a seal 44 with only one web 56 (L-shaped profile) according to FIGS. 6, 7 and 8.

Figure 11:
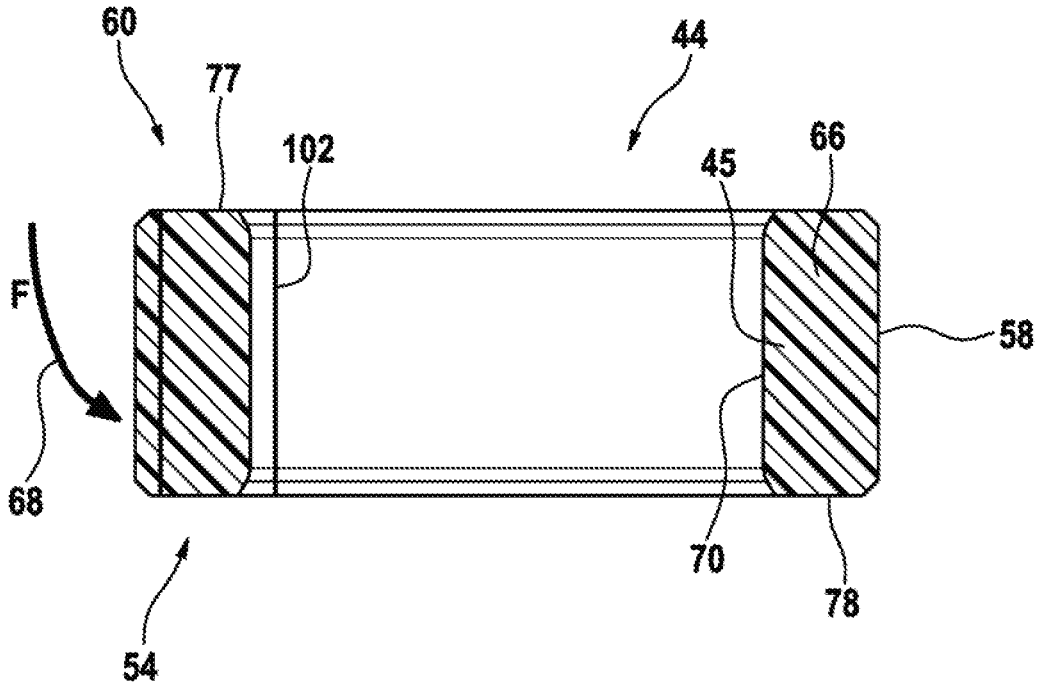
FIG. 11 shows an alternative configuration of a seal for the piston pump from FIG. 2.

FIG. 11 shows an alternative embodiment, with a simple structure, of a seal 44 which only has base portion 45 and is overall formed to be sleeve-shaped. Seal 44 has a uniform seal wall 66 in the case of which inner lateral surface 70 and outer lateral surface 58 are parallel to one another. Seal 44 thus has an I-shaped cross-section. If a force F (arrow 68) acts on seal 44, parallel displacement 102 thus arises. This may be advantageous if a larger sealing surface is required. Such a configuration of the seal with a rectangular profile in cross-section is comparatively simple in the production process.

The invention claimed is:

1. A piston pump, comprising:

a pump housing;

a pump piston;

a conveying space delimited at least by the pump housing and the pump piston;

a seal configured to seal off the conveying space; and a separate guide element configured to guide the pump piston, wherein the seal and the guide element are arranged between the pump piston and the pump housing, and wherein the seal is configured as a plastic ring and comprises:

a substantially sleeve-shaped base portion extending axially along the pump piston the sleeve-shaped base portion including a cylindrical outer surface and an inner surface that sealingly contacts the pump piston; and a first flange projecting radially outwardly from the cylindrical outer surface a first axial end region of the base portion, the seal terminating at an outer radial end of the first flange.

2. The piston pump as claimed in claim 1, further comprising a fastening ring arranged between the pump housing and the pump piston and configured to retain the seal between the pump housing and the pump piston.

3. The piston pump as claimed in claim 2, further comprising a spring element, which biases the seal against the fastening ring, arranged between the pump piston and the pump housing.

4. The piston pump as claimed in claim 1, further comprising a further guide element arranged in a seal carrier of the piston pump.

5. The piston pump as claimed in claim 1, wherein the seal has an overall L-shaped cross-section, with the base portion defining a first leg of the L-shaped cross-section and the first flange defining a second leg of the L-shaped cross-section.

6. The piston pump as claimed in claim 1, wherein the seal further comprises, at a second axial end region of the base portion, a second flange projecting radially outwardly from the base portion such that the seal has an overall U- or C-shaped cross-section with the base portion forming a central leg of the U- or C-shaped cross-section.

7. The piston pump as claimed in claim 6, wherein a radially outer edge of one or both of the first flange and the second flange has play to a circumferential wall of a recess of the pump housing in which the pump piston is received.

8. The piston pump as claimed in claim 1, wherein the seal further comprises a circumferential collar projecting axially from an axial end face of the seal.

9. The piston pump as claimed in claim 2, wherein the guide element and the fastening ring are combined so as to define a single component.

10. The piston pump as claimed in claim 1, further comprising an O-ring arranged between a radially outer lateral surface of the base portion and the pump housing.

11. The piston pump as claimed in claim 1, wherein the piston pump is configured as a high-pressure fuel pump for an internal combustion engine.

12. The piston pump as claimed in claim 10, further comprising a supporting ring arranged between the radially outer lateral surface of the base portion and the pump housing and configured to support the O-ring.

13. The piston pump as claimed in claim 1, wherein the outer radial end of the first flange is spaced apart from an inner circumferential wall of the pump housing such that the outer radial end of the first flange has a radial play.

14. A piston pump, comprising:

a pump housing;

a pump piston;

a conveying space delimited at least by the pump housing and the pump piston;

a seal configured to seal off the conveying space; and a separate guide element configured to guide the pump piston, wherein the seal and the guide element are arranged between the pump piston and the pump housing, wherein the seal is configured as a plastic ring with a substantially sleeve-shaped base portion having a cylindrical outer surface and an inner surface that sealingly contacts the pump piston, wherein the seal further comprises a first flange projecting radially outwardly from the cylindrical outer surface, and wherein the seal is configured as a pressure-activated seal in which, at an initial pressure, the base portion is spaced apart from the pump piston and, as pressure is built up in the conveying space, the pressure acts on the cylindrical outer surface of the base portion to urge the base portion into contact with the pump piston.

* * * * *